United States Patent [19]

Gurubatham

[11] 4,266,565

[45] May 12, 1981

[54] DISHWASHER SPRAY ARM MOUNTING

[75] Inventor: Vincent P. Gurubatham, St. Joseph, Mich.

[73] Assignee: Whirpool Corporation, Benton Harbor, Mich.

[21] Appl. No.: 84,636

[22] Filed: Oct. 12, 1979

[51] Int. Cl.[3] ..... B08B 3/02

[52] U.S. Cl. ..... 134/144; 134/154; 134/176; 239/259; 308/72

[58] Field of Search ..... 239/243, 245–246, 239/259, 261, 264; 308/140–141, 72; 134/144, 149, 154, 175–177, 179–180, 183

[56] References Cited

U.S. PATENT DOCUMENTS

| | | | |
|---|---|---|---|
| 1,053,715 | 2/1913 | Cromwell | 308/141 |
| 1,977,763 | 10/1934 | Gordon | 239/259 |
| 3,091,400 | 5/1963 | Aubert | 239/264 X |
| 3,180,348 | 4/1965 | Clearman | 134/176 |
| 3,363,950 | 1/1968 | Cole | 308/72 |
| 3,854,762 | 12/1974 | Spiegel | 292/197 |
| 3,951,684 | 4/1976 | LaPrad et al. | 134/144 |
| 4,174,723 | 11/1979 | Long | 134/144 |

*Primary Examiner*—Robert L. Bleutge

*Attorney, Agent, or Firm*—Wegner, Stellman, McCord, Wiles & Wood

[57] ABSTRACT

An upper spray arm is mounted to the underside of the upper dish rack of a dishwasher and rotates in response to a jet of water supplied through the lower spray arm. The upper spray arm mounting is provided with a self-aligning bearing which includes a stationary mounting platform attached to the upper dish rack and a flanged, cylindrical bearing connected to the spray arm. An enlarged bore in the mounting platform accommodates the bearing cylinder and permits radial movement of the bearing cylinder relative to the platform. The bearing flange transmits thrust forces to the stationary platform and slides radially relative to the platform to the extent the platform bore is larger than the bearing cylinder. Impetus for radial movement of the bearing and spray arm is produced by a bell shaped receiver located on the underside of the spray arm. An angular wall is presented to the water jet if the jet and arm should be misaligned producing a sidewardly directed force which causes corrective movement of the upper spray arm and attached bearing relative to the stationary mount and upper dish rack.

13 Claims, 3 Drawing Figures

DISHWASHER SPRAY ARM MOUNTING

BACKGROUND OF THE INVENTION

The present invention is directed to dishwashing appliances, and particularly dishwashers which include upper and lower dish racks and separate spray arms associated with each rack. U.S. Pat. No. 3,180,348, which issued to J. F. Clearman on Apr. 27, 1965 and U.S. Pat. No. 3,854,762, which issued to Ray W. Spiegel et al on Dec. 17, 1974, both of which are assigned to the assignee of the present invention, describe dishwashing appliances which contain dual spray arms, the upper of which is driven by a liquid jet or stream produced by a recirculation pump.

Both of the above patents disclose a dishwasher which contains upper and lower dish racks which may be withdrawn to permit loading. Mounted beneath the lower dish rack is a spray arm which rotates to direct washing liquid, which may be water or water with cleansing agents added, to articles loaded in the lower rack and includes a central aperture through which a jet of liquid is directed toward the upper dish rack.

A rotatable upper spray arm mounted to the upper dish rack receives the jet of washing liquid in a conical receiver which directs the liquid to the upper spray arm. Nozzles spaced along the spray arms are positioned to cause the spray arm assembly to rotate and distribute washing liquid over the dishes.

In order to be efficient, the upper spray arm receiver must be centrally located with respect to the jet of washing liquid produced by the recirculation pump. Misalignment produces unbalanced forces on the upper spray arm and inefficient distribution of washing liquid. Alignment of the upper spray arm and liquid jet has proven difficult to accomplish in the past since it is necessary that the upper dish rack be movable with respect to the dishwasher in order to permit dishes to be conveniently loaded. The above mentioned U.S. Pat. No. 3,180,348 discloses a mechanism for manually adjusting the horizontal position of the upper spray arm with respect to the upper dish rack by manual rotation of an eccentric bearing mounting. It thus has been necessary to provide means which will accurately position the upper rack with respect to the cabinet and also accurately position the upper spray arm with respect to the upper rack. Close tolerance manufacturing and assembly techniques have been necessary to provide the required positional accuracy.

These methods materially increase the manufacturing expenses involved and in addition, have not always proven successful. Factors such as remaining production tolerances, the necessary adjustability of the top rack, distortion of a lower dish rack mounted jet stream directing tower and the position of the lower arm with respect to the cabinet all may still contribute to produce misalignment of the upper spray arm with respect to the jet of washing liquid.

SUMMARY OF THE INVENTION

To correct the above problems, a "self-centering" spray arm has been devised which automatically adjusts to compensate for any misalignment of the upper spray arm and water or washing liquid jet and positions the upper spray arm directly in line with the jet.

The mounting includes a stationary mounting platform structure having a flat bearing surface and a central clearance aperture. A flanged, cylindrical bearing is attached to the spray arm and extends through the platform aperture until the bearing flange contacts the platform surface. A disk-like retainer holds the bearing in proper relationship to the platform.

The platform aperture is oversized with respect to the bearing cylinder, and thus the bearing and attached spray arm are free to move laterally with respect to the platform, such movement being limited only by contact between the bearing cylinder and the side walls of the platform aperture.

Impetus for lateral movement of the bearing is provided by a bell shaped receiver which accepts the jet of washing liquid and directs it to internal passageways within the spray arm.

Should the liquid jet be off-center with respect to the upper spray arm, the shape of the receiver causes a sidewardly acting force to be produced which in turn causes the spray arm and bearing assembly to move laterally with respect to the mounting platform. Lateral movement stops when either the spray arm receiver and water jet are aligned causing side force equalization or the bearing cylinder comes in contact with the platform bore.

DESCRIPTION OF THE PREFERRED EMBODIMENT

Figure 1:
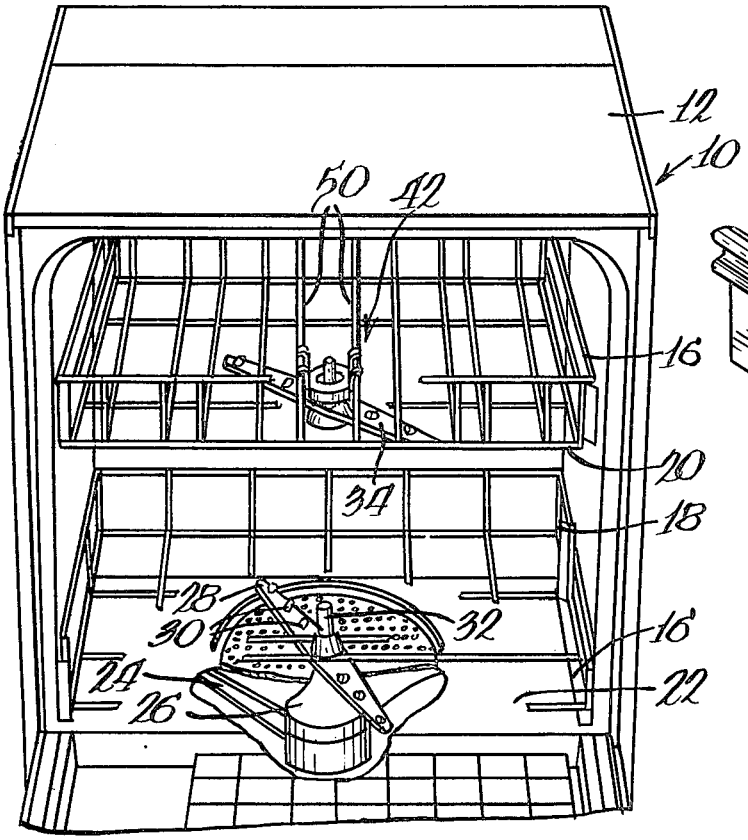
FIG. 1 illustrates a front loading dishwasher with the door in the open position and with portions of the dishwasher broken away for illustration.

Referring to the drawings, and in particular FIG. 1, a front loading dishwasher generally designated 10 is shown which includes a cabinet 12 surrounding a washing cavity 13 and having a door 14 for closing the cavity 13. Mounted within the cabinet on roller guides 16 are a lower dish rack 18 and an upper dish rack 20 which are transversely movable to be individually withdrawn to permit loading dishes into the cabinet 12.

Located in the bottom interior surface 22 of the washing cavity 13, (a portion of which is broken away for illustration) is a sump 24 which collects washing liquid for recirculation and a pump 26 which delivers this liquid for distribution.

In fluid communication with the pump 26 and mounted for rotation with respect to the pump is a lower spray arm 28 having nozzles 30 which receives washing liquid from the pump 26 and distributes the same over dishes located in the lower rack 18.

The dishwasher thus far described is conventional in construction and is more fully described in U.S. Pat. No. 3,854,762, issued to Spiegel et al, on Dec. 17, 1974. Additional features and details of the workings of the dishwasher are not material to this invention and need not be presented here.

Centrally located on the lower dish rack 18 is a liquid directing nozzle or "tower" 32 which directs a jet of washing liquid or fluid 92 upwardly toward an upper spray arm 34 mounted on the upper rack 20. Washing liquid is supplied to the tower 32 by the pump 26 and may consist of liquid supplied either independently of liquid supplied to the lower arm 28 or may comprise a portion of such liquid supply. The tower 32 may rotate with the spray arm 28.

Figure 2:
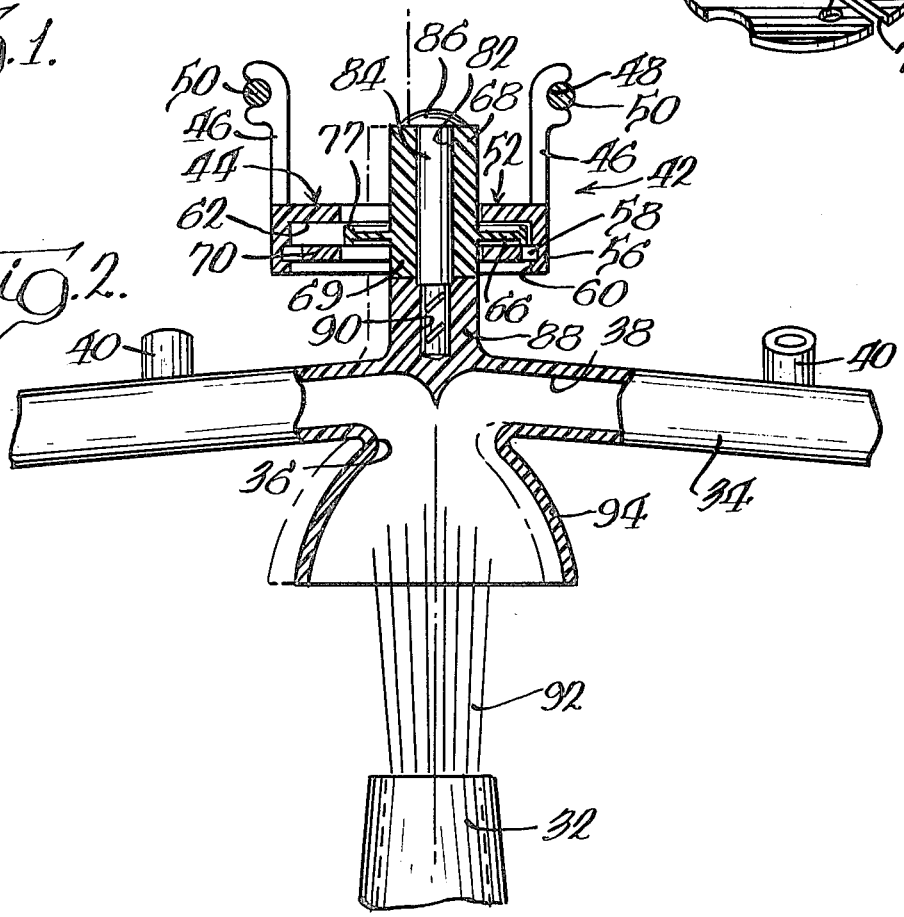
FIG. 2 is a partial vertical sectional view of the bearing which is the subject matter of this invention and a portion of the upper spray arm.

Referring to FIG. 2, the upper spray arm 34 includes a bell shaped receiving means 94 which receives the upwardly directed jet of washing liquid and has an opening 36 in an upper central portion thereof to direct this liquid to a distributing means comprising internal passageways 38 within the spray arm 34. The passageways 38 conduct liquid to nozzles 40 located along the spray arm 34, the nozzles directing liquid over dishes located in the upper rack 20. At least one of the nozzles 40 is mounted to the spray arm 34 at an angle to cause the arm 34 to rotate and distribute liquid in a circular pattern.

As shown in FIGS. 1 and 2, the spray arm 34 is connected to the upper dish rack 20 by a self-aligning bearing structure, generally designated 42. The bearing includes a stationary mount 44 which has four upwardly extending attachment arms 46 which terminate in outwardly facing semicircular notches 48 adapted to surround and engage two wire elements 50 which are formed to make up a portion of the upper dish rack 20.

The attachment arms 46 support a circular, horizontal platform 52 which includes a lower platform surface 62 and forms a central circular clearance aperture 54. Extending downwardly from the platform 52 is a circular perimetrical collar 56 which includes a circular groove 58 formed in an inner surface 60 of the collar spaced from the lower platform surface 62.

Fitted within the collar 56 is a cylindrical flanged bearing 64 having ends 68 and 69 and a substantially planar flange 66 which is formed at a point intermediate the cylinder ends 68 and 69. The cylindrical bearing end 68 extends through the the platform aperture 54 such that the flange 66 is adjacent the lower surface 62 of the platform 52.

To retain the bearing flange 66 adjacent the platform lower surface 62 in juxtaposed relationship thereto, a split retaining means or ring 70 is provided. The undeformed outer diameter and thickness of the ring 70 closely match the dimensions of the collar groove 58. A slot 72 and a pair of holes 74 adjacent and on either side of the slot 72 permit a suitable tool to diametrically deform the ring 70 and insert the same in the collar groove 58. The retaining ring 70 further includes a central bore or aperture 76 of the same diameter and concentric with platform aperture 54 when the retaining ring 70 is inserted within the collar groove 58.

These concentric apertures 54 and 76 have diameters which greatly exceed the diameter of the cylindrical ends 68 and 69 of the bearing 64 and thus permit lateral movement of the bearing 64 with respect to the platform 52 in all directions. To facilitate this movement, the collar groove 58 is spaced from the platform lower surface 62 a distance slightly greater than the thickness of the bearing flange 66, thereby preventing compression of the flange that would cause binding of the flange 66 between the surface 62 and retaining ring 70.

Also, as best seen in FIG. 2, both sides of the bearing flange 66 are relieved to produce an annular rim 77 which extends upwardly to contact the lower platform surface 62, and downwardly to contact the retaining ring 70. The rim 77 provides a limited contact area between the flange 66 and the platform 52 and the retaining ring 70 to decrease friction and permit the bearing 62 to move laterally more easily.

Figure 3:
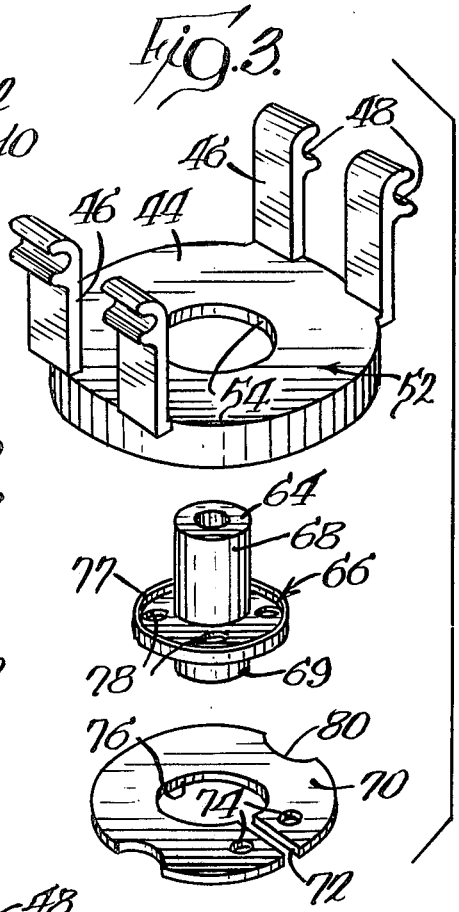
FIG. 3 is an exploded perspective view illustrating the relationship of the bearing elements.

As best shown in FIG. 3, the flange 66 forms a number of through openings 78 and the retaining ring 70 is formed with semicircular notches 80 in its periphery. The openings 78 and notches 80 form a drainage means to permit water and food particles to flow through and around the respective mounting elements.

As shown in FIG. 2, a circular bore 82 is formed completely through the center of bearing cylinder 64 which accommodates the shank of a connecting pin 84. The pin 84 includes an enlarged head 86, the diameter of which is greater than the bore 82. The pin length is greater than the overall length of the bearing 64 and projects downward a distance sufficient to adequately engage the spray arm 34. The spray arm 34 has an upwardly extending projection 88 which includes a blind hole 90 sized to grip the connecting pin 84.

The connecting pin 84 is driven into the spray arm blind hole 90 so as to loosely connect the spray arm 34 to the bearing 64 to allow relative location between the spray arm 34 and the bearing 64. Thus, the spray arm 34 and pin 84 rotate as a unit relative to the bearing 64 and platform 52, with the bearing 64 free to move laterally within the collar 56.

Referring to FIG. 2, the bell shaped receiving means 94 is shaped as an annular member to prevent an inwardly inclined surface at a radial distance from the center line of the spray arm 34 greater than opening 36. In operation, when the jet 92 and spray arm opening 36 are properly aligned, washing liquid will enter the opening 36 and be distributed through passageways 38 to nozzles 40. Since at least one of the nozzles 40 is angled, water spray from the angled nozzle will cause the spray arm 34 to rotate. The pin 84 will rotate with the spray arm 34.

In the event the spray arm opening 36 is not aligned with the liquid jet 92 when the spray begins, or becomes misaligned during operation, the self-aligning feature of this bearing arrangement will be brought into play. If the bearing 64 and spray arm 34 are misaligned to the left with respect to the liquid jet 92, as indicated by the broken line in FIG. 2, the liquid jet 92 will impinge upon a larger area of the spray arm receiving means 94 to the right of the spray arm 34 center line than to the left. This imbalance will cause a net horizontal force acting to the right which will tend to force the spray arm in that direction. Because the enlarged apertures 54 and 76 provide clearance space surrounding the bearing cylinder 64, the bearing flange 66 will slide laterally relative to the platform 52 and thereby move the center of the spray arm 34 into alignment with the liquid jet 92. Lateral movement of the bearing 64 will continue until either the cylindrical portion 68 of the bearing 64 contacts the inner surface of the aperture 54 or until the horizontal forces acting upon the spray arm 34 become balanced in all directions which will only occur when the liquid jet 92 is centered within the opening 36.

If the liquid jet 92 center line remains stationary during operation, the spray arm 34 will adjust its position laterally, align itself with the center line of the spray jet 92, and rotate in this position. If the center line of the liquid jet 92 changes continuously, as would be the case if the tower 32 was rotatable with the lower spray arm 28 and deformed or misaligned with respect to the spray arm, the spray arm 34 will adjust continually to remain positioned over the center line of the liquid jet 92 within the limits of the clearance apertures 54 and 76. This situation would actually improve the cleansing action of the upper spray arm 34 since the arm would continually be shifting position laterally and thereforce the spray pattern would constantly change. This would allow a greater area to be encompassed by spray directed from the upper spray arm 34.

While the foregoing description sets forth the invention in its preferred form, this description should be considered exemplary and not limiting. The spray arm mounting could be modified somewhat and still retain its self-aligning features. For example, the mounting platform 52 could be formed without the central aperture 54. Thus, the bearing 64 would be formed to terminate at the flange 66, eliminating cylindrical end 68. This would require pin head 86 to be positioned below the plane of the flange 66 so as not to interfere with the movement of rim 77 against surface 62, but entry of food particles through aperture 54 causing interference with the bearing movement would be prevented.

Other aspects, objects and advantages of the spray arm mounting disclosed will become apparent through careful study of the drawings, specification and appended claims.

I claim:

1. A self-aligning bearing assembly for a dishwasher spray arm comprising:

a stationary bearing support including a surface and a perimetrical collar extending from said surface, said collar defining an inner transverse dimension;

a bearing rotatably connected to said spray arm including a cylinder having an enlarged flange with substantially planar surfaces extending from said cylinder, said flange having a transverse dimension less than the inner transverse dimension of said collar; and retaining means within and attached to said collar including an annular retainer having a central bore of a diameter greater than said bearing cylinder but less than the transverse dimension of said flange for supporting said flange and maintaining said flange slidably adjacent to said support surface, said bore accommodating said bearing cylinder and permitting limited lateral movement of said bearing relative to said support and said retainer.

2. The self-aligning bearing assembly of claim 1 wherein said support includes an aperture of a diameter equal to and aligned with said retainer bore and said bearing includes equal diameter cylinders extending from both sides of said flange, one of said cylinders projecting through said aperture and the other of said cylinders projecting through said bore.

3. The self-aligning bearing assembly of claim 2 wherein said bearing flange includes a rim extending from at least one of said flat flange surfaces substantially parallel to said cylinders to space said flange away from one of said support surface and said retainer and thereby reduce frictional contact between said flange and said one of said support and retainer.

4. The self-aligning bearing assembly of claim 3 wherein said flange flat surface forms at least one flange through opening and said annular retainer forms at least one gap between said retainer and said collar to permit fluid flow through said self-aligning bearing assembly.

5. A self-aligning bearing assembly for a dishwasher spray arm comprising:

a support formed as a flat circular disk having an annular collar extending from the perimeter thereof and having a circular concentric aperture of a given diameter therethrough, said collar including an annular groove around an inner surface and an inner diameter;

a cylindrical bearing rotatably connected to said spray arm including a cylinder having ends and having a diameter less than the given diameter of said aperture, said cylinder having a flange located intermediate said ends of said cylinder and extending in a plane perpendicular to the longitudinal axis of said bearing, said flange having a diameter greater than the given diameter of said aperture but less than the inner diameter of said collar, said cylinder extending through said aperture with said flange slidably adjacent to said support and contained within said collar; and a diametrically deformable resilient ring shaped retainer having a thickness and an undeformed diameter substantially equal to the dimensions of said groove to slidably retain said flange between said support and said retainer when said retainer is positioned in said groove, said retainer including a concentric bore formed to accommodate said cylinder and to be aligned with said aperture when said retainer is positioned within said groove, the diametrical difference between the flange diameter and the inner diameter of the collar being greater than the diametrical difference between the cylinder diameter and the aperture given diameter, thereby permitting said bearing to slide laterally relative to said support and said retainer a distance limited only to the diametrical difference between said bearing and said aperture.

6. An improved spray arm and mounting for a dishwasher having a washing chamber, nozzle means located in the lower portion of said chamber for directing a jet of fluid toward said spray arm, and distributing means within said arm for distributing fluid directed to said arm, the improvement resulting in a spray arm which will continuously align itself with respect to said fluid jet, said improvement comprising:

a stationary spray arm mount attached to an upper portion of said chamber;

a bearing slidably juxtaposed to said mount;

retaining means associated with said mount for loosely retaining said bearing in said juxtaposed relationship to said mount; and a spray arm attached to said bearing including a receiving means for receiving said fluid jet for passage to said distributing means through a central opening in an upper portion of said receiving means, said receiving means transforming energy contained in said fluid jet into a correcting alignment force to slide said bearing relative to said mount whenever said jet does not coincide with said central opening in said receiving means.

7. The improved spray arm and mounting of claim 6 wherein said spray arm mount is comprised of a circular platform having a flat lower surface, a circular collar extending downwardly from said surface and wall means defining a circular aperture in the center of said circular platform.

8. The improved spray arm and mounting of claim 7 wherein said bearing is comprised of a circular flange of a diameter greater than said aperture, and a cylinder of a diameter less than said aperture extending from said flange upwardly through said aperture and downwardly through a bore in said retaining means, said flange slidably juxtaposed to said platform surface.

9. The improved spary arm and mounting of claim 8 further including an annular groove around an inner surface of said collar, said retaining means comprising a diametrically deformable ring having a thickness and undeformed outer diameter substantially equal to the dimensions of said groove, said ring supporting and retaining said flange in said juxtaposed relationship to said platform.

10. The improved spray arm and mounting of claim 9 further including a rim extending upwardly and downwardly from said flange to reduce the contact area between the flange and the platform and the flange and the ring to thereby reduce frictional forces.

11. The improved spray arm and mounting of claim 10 including drainage means defining passages through said flange and said ring for passage of fluids and particles.

12. The improved spray arm and mounting of claim 7 wherein said dishwasher includes a wire dish rack mounted to the upper portion of said chamber, said platform attached to the rack by a plurality of legs extending upwardly from said platform, said legs having semicircular notches at the distal faces to engage said dish rack wires.

13. In a dishwasher having a washing chamber, upper and lower dish racks each traversely movable between loading and operating positions, nozzle means mounted in the lower portion of the washing chamber for directing a stream of washing fluid upwardly, a rotatable upper spray arm having receiving means for receiving and distributing means for distributing fluid from said nozzle means, said receiving means comprising a downwardly extending annular bell shaped sidewall defining an opening in said spray arm and mounting means affixed to the central underside of said upper dish rack for mounting said spray arm for continuous alignment of said opening in the stream of fluid, said mounting means comprising:

a stationary member affixed to the central underside of said upper dish rack, said stationary member including a circular platform, a circular collar extending downwardly from said platform, an annular groove around an inner surface of said collar, a plurality of legs extending upwardly from said platform, each of said legs having a semicircular notch, for attachment to the upper dish rack, and wall means defining a circular aperture in the center of said circular platform;

a bearing slidably juxtaposed to said stationary member for horizontal movement, said bearing comprising a circular disk having a diameter greater than said wall means, a cylinder having a diameter less than said wall means extending upward and downward from and coaxially with said disk, said cylinder defining a circular bore also coaxial with said disk, a flange extending upward and downward from the outer edge of said disk and drainage means defining passages through said disk for passage of fluids and particles;

a retainer positioned in said annular groove of said stationary member for retaining said bearing in said slidably juxtaposed relationship to said stationary member, said retainer comprising a circular ring having a slot therein, means defining two circular apertures adjacent either side of said slot and means defining a plurality of semicircular notches on the outer diameter of said ring for passage of fluids and particles, said ring having an inner diameter equal to said wall means; and a pin with a head at one end extending rotatably through said circular bore of said bearing, said pin extending downwardly for affixing said upper spray arm to said bearing.

* * * * *

UNITED STATES PATENT AND TRADEMARK OFFICE

CERTIFICATE OF CORRECTION

PATENT NO. : 4,266,565

DATED : May 12, 1981

INVENTOR(S) : VINCENT P. GURUBATHAM

It is certified that error appears in the above-identified patent and that said Letters Patent are hereby corrected as shown below:

Item 73, front page, correct name of Assignee from "Whirpool Corporation" to --Whirlpool Corporation--.

Signed and Sealed this

*Eighth* Day of *September 1981*

[SEAL]

*Attest:*

GERALD J. MOSSINGHOFF

*Attesting Officer*

*Commissioner of Patents and Trademarks*